US011367398B2

(12) United States Patent
Huangfu et al.

(10) Patent No.: US 11,367,398 B2
(45) Date of Patent: Jun. 21, 2022

(54) PIXEL CIRCUIT FOR CONTROLLING JUNCTION VOLTAGE OF LIGHT EMITTING ELEMENT TO BE WITHIN PRESET VOLTAGE RANGE, DISPLAY PANEL AND DISPLAY DEVICE

(71) Applicant: BOE Technology Group Co., Ltd., Beijing (CN)

(72) Inventors: Lujiang Huangfu, Beijing (CN); Li Wang, Beijing (CN); Libin Liu, Beijing (CN)

(73) Assignee: BOE Technology Group Co, Ltd., Beijing (CN)

( * ) Notice: Subject to any disclaimer, the term of this patent is extended or adjusted under 35 U.S.C. 154(b) by 0 days.

(21) Appl. No.: 17/244,977

(22) Filed: Apr. 30, 2021

(65) Prior Publication Data

US 2022/0093045 A1 Mar. 24, 2022

(30) Foreign Application Priority Data

Sep. 21, 2020 (CN) ..... 202010998465.6

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2300/0426* (2013.01)

(58) Field of Classification Search
None
See application file for complete search history.

(56) References Cited

U.S. PATENT DOCUMENTS

2010/0007645 A1 1/2010 Ono
2016/0126287 A1* 5/2016 Her ..... H01L 27/156 257/88
2018/0190197 A1* 7/2018 Chang ..... G09G 3/3233
2018/0315374 A1 11/2018 Zhang et al.
2019/0251905 A1 8/2019 Yang et al.
2021/0134232 A1* 5/2021 Ueno ..... G09G 3/3233

FOREIGN PATENT DOCUMENTS

CN 203882588 U 10/2014
CN 106097964 A 11/2016
CN 107424570 A 12/2017
CN 108682386 A 10/2018

OTHER PUBLICATIONS

Shin et al., Novel a-Si:H TFT Vth Compensation Pixel Circuit for AMOLED, Oct. 8, 2006, Proc. of ASID, New Delphi, p. 2 (Year: 2006).*
Office Action dated Apr. 23, 2021 for Chinese Patent Application No. 202010998465.6 and English Translation.

* cited by examiner

*Primary Examiner* — Kirk W Hermann
(74) *Attorney, Agent, or Firm* — Ling Wu; Stephen Yang; Ling and Yang Intellectual Property

(57) ABSTRACT

A pixel circuit includes a potential compensation subcircuit configured to control a junction voltage of a light emitting element to be within a preset voltage range according to an initial voltage input by an initialization reset voltage terminal and a reset sequence input by a reset sequence signal terminal. The preset voltage range is higher than zero and lower than an emission threshold voltage of the light emitting element.

18 Claims, 6 Drawing Sheets

PIXEL CIRCUIT FOR CONTROLLING JUNCTION VOLTAGE OF LIGHT EMITTING ELEMENT TO BE WITHIN PRESET VOLTAGE RANGE, DISPLAY PANEL AND DISPLAY DEVICE

CROSS-REFERENCE TO RELATED APPLICATION

The present application claims the priority of Chinese Patent Application No. 202010998465.6 filed to the CNIPA on Sep. 21, 2020, the content of which is incorporated herein by reference.

TECHNICAL FIELD

Embodiments of the present disclosure relate to but are not limited to the technical field of display, in particular to a pixel circuit, a display panel and a display device.

BACKGROUND

In some technologies, a reset sequence configured in a pixel circuit of an OLED (Organic Light-emitting Diode) display device resets electrodes of a pixel OLED (i.e., a light emitting element) by resetting a TFT (Thin Film Transistor), reduces a forward junction voltage of the pixel OLED, and clears charges in the related capacitance, which can effectively prevent a noise current, for example, residual charges in the OLED junction capacitance and parasitic capacitance of an anode node of the light emitting element are discharged by the pixel OLED, which causes uncontrolled light emission. The mechanism has been widely used in AMOLED (Active-matrix organic light emitting diode) pixel circuits.

SUMMARY

The following is a summary of subject matter described in detail herein. This summary is not intended to limit the protection scope of the claims.

An embodiment of the present disclosure provides a pixel circuit including a reset subcircuit, a data refreshing subcircuit, a driving subcircuit, a light emission control subcircuit and a potential compensation subcircuit.

The reset subcircuit is connected with a driving node and is configured to reset the driving node.

The data refreshing subcircuit is connected with the driving node and is configured to store a data voltage and control a voltage of the driving node to be a first voltage.

The driving subcircuit is connected with the driving node and the light emission control subcircuit, respectively, and is configured to be turned on or off according to the voltage of the driving node.

The light emission control subcircuit is connected with a light emitting element and is configured to control a light emission driving voltage to be written in an anode node of a the light emitting element via the driving subcircuit and the light emission control subcircuit.

The potential compensation subcircuit is connected with the light emitting element and is configured to control a junction voltage of the light emitting element to be within a preset voltage range according to an initial voltage input by an initialization reset voltage terminal and a reset sequence input by a reset sequence signal terminal, wherein the preset voltage range is higher than zero and lower than an emission threshold voltage of the light emitting element.

In an exemplary embodiment, the potential compensation subcircuit is at least connected to the initialization reset voltage terminal and the reset sequence signal terminal and is configured to, in a reset phase and/or a compensation and data refreshing phase, control a junction voltage of the light emitting element to be within the preset voltage range according to an initial voltage input by the initialization reset voltage terminal and the reset sequence input by the reset sequence signal terminal.

In some alternative implementations of the embodiments of the present disclosure, the potential compensation subcircuit includes a reset transistor and a compensation capacitor.

A gate of the reset transistor is electrically connected to the reset sequence signal terminal, a first electrode of the reset transistor is electrically connected to the initialization reset voltage terminal, and a second electrode of the reset transistor is electrically connected to the anode node.

A first electrode plate of the compensation capacitor is electrically connected to the reset sequence signal terminal, and a second electrode plate of the compensation capacitor is electrically connected to the anode node.

Optionally, the potential compensation subcircuit is further electrically connected to a preset sequence signal terminal in a signal circuit, the preset sequence signal terminal is configured to input a preset sequence. The potential compensation subcircuit is configured to control the junction voltage of the light emitting element to be within the preset voltage range according to the preset sequence, the initial voltage and the reset sequence.

Optionally, the preset sequence signal terminal is a compensation and refreshing sequence signal terminal, and the preset sequence is a compensation and refreshing sequence.

The potential compensation subcircuit includes a reset transistor, a compensation transistor and a compensation capacitor.

A gate of the reset transistor is electrically connected to the reset sequence signal terminal, a first electrode of the reset transistor is electrically connected to the initialization reset voltage terminal, and a second electrode of the reset transistor is electrically connected to a first electrode of the compensation transistor and a first electrode plate of the compensation capacitor.

A gate of the compensation transistor is electrically connected to the compensation and refreshing sequence signal terminal, and a second electrode of the compensation transistor is electrically connected to the anode node.

A second electrode plate of the compensation capacitor is electrically connected to the initialization reset voltage terminal.

Optionally, the preset sequence signal terminal is a light emission driving sequence signal terminal, and the preset sequence is a light emission driving sequence.

The potential compensation subcircuit includes a reset transistor, a compensation transistor and a compensation capacitor.

A gate of the reset transistor is electrically connected to the reset sequence signal terminal, a first electrode of the reset transistor is electrically connected to the initialization reset voltage terminal, and a second electrode of the reset transistor is electrically connected to a first electrode of the compensation transistor and a first electrode plate of the compensation capacitor.

A gate of the compensation transistor is electrically connected to the light emission driving sequence signal terminal, and a second electrode of the compensation transistor is electrically connected to the anode node.

A second electrode plate of the compensation capacitor is electrically connected to the anode node.

In an exemplary embodiment, the reset subcircuit is connected to the driving node, the initialization reset voltage terminal and the reset sequence signal terminal. The reset subcircuit is configured to, in a reset phase in response to the reset sequence input by the reset sequence signal terminal, connect the initialization reset voltage terminal to the driving node, and reset the driving node.

The data refreshing subcircuit is connected to the driving node, a compensation and refreshing sequence signal terminal, a light emission driving sequence signal terminal, a reference voltage input terminal and a data voltage input terminal. The data refreshing subcircuit is configured to, in a compensation and data refreshing phase in response to a compensation and refreshing sequence input by the compensation and refreshing sequence signal terminal, write a data voltage input by the data voltage input terminal in and stored the data voltage, and in a light emission driving phase, in response to a light emission driving sequence input by the light emission driving sequence signal terminal, control the voltage of the driving node to decrease to the first voltage according to the data voltage and a reference voltage input by the reference voltage input terminal.

The driving subcircuit is connected to the driving node, a light emission driving voltage input terminal and the data refreshing subcircuit. The driving subcircuit is configured to, in the reset phase in response to the reset voltage of the driving node, be turned on; in the compensation and data refreshing phase, maintain a turned-on state to allow the light emission driving voltage input terminal to charge the driving node via the driving subcircuit and the data refreshing subcircuit till the voltage of the driving node increases to a second voltage to turn off the driving subcircuit; and in the light emission driving phase in response to the first voltage, be turned on.

The light emission control subcircuit is connected to the driving subcircuit, the anode node of the light emitting element and the light emission driving sequence signal terminal. The light emission control subcircuit is configured to, in the light emission driving phase in response to the light emission driving sequence input by the light emission driving sequence signal terminal, be turned on to write the light emission driving voltage input by the light emission driving voltage input terminal in the anode node via the driving subcircuit and the light emission control subcircuit to control the light emitting element to emit light.

In some alternative implementations of the embodiments of the present disclosure, optionally, the driving subcircuit includes a third transistor and the light emission control subcircuit includes an eighth transistor.

A gate of the third transistor is electrically connected to the driving node, a first electrode of the third transistor is electrically connected to the light emission driving voltage input terminal, and a second electrode of the third transistor is electrically connected to a first electrode of the eighth transistor.

A gate of the eighth transistor is electrically connected to the light emission driving sequence signal terminal, and a second electrode of the eighth transistor is electrically connected to the anode node.

Optionally, the data refreshing subcircuit includes a power storage element, a first transistor, a second transistor, a sixth transistor.

A second electrode plate of the power storage element is electrically connected to the driving node.

A gate of the first transistor is electrically connected to the compensation and refreshing sequence signal terminal, a first electrode of the first transistor is electrically connected to the data voltage input terminal, and a second electrode of the first transistor is electrically connected to a first electrode plate of the power storage element.

A gate of the second transistor is electrically connected to the compensation and refreshing sequence signal terminal, a first electrode of the second transistor is electrically connected to a second electrode of the third transistor, and a second electrode of the second transistor is electrically connected to the driving node.

A gate of the sixth transistor is electrically connected to the light emission driving sequence signal terminal, a first electrode of the sixth transistor is electrically connected to the reference voltage input terminal, and a second electrode of the sixth transistor is electrically connected to the first electrode plate of the power storage element.

Optionally, the reset subcircuit includes a fifth transistor, a gate of which is electrically connected to the reset sequence signal terminal, a first electrode of which is electrically connected to the reference voltage input terminal, and a second electrode of which is electrically connected to the first electrode plate of the power storage element; and a fourth transistor, a gate of which is electrically connected to the reset sequence signal terminal, a first electrode of which is electrically connected to the initialization reset voltage terminal, and a second electrode of which is electrically connected to the driving node.

Optionally, multiple pixel circuits are electrically connected in cascade, and a reset sequence signal terminal of the pixel circuit at a present stage is a compensation and refreshing sequence signal terminal of the pixel circuit at a previous stage.

In an exemplary embodiment, the reset subcircuit is connected to the driving node, the initialization reset voltage terminal and the reset sequence signal terminal. The reset subcircuit is configured to, in a reset phase in response to the reset sequence input by the reset sequence signal terminal, connect the initialization reset voltage terminal to the driving node and reset the driving node.

The data refreshing subcircuit is connected to the driving node, a compensation and refreshing sequence signal terminal, a light emission driving voltage input terminal and a data voltage input terminal. The data refreshing subcircuit is configured to, in a compensation and data refreshing phase in response to a compensation and refreshing sequence input by the compensation and refreshing sequence signal terminal, write a data voltage input by the data voltage input terminal in and stored the data voltage till the voltage of the driving node is a first voltage.

The driving subcircuit is connected to the driving node, the light emission control subcircuit and the data refreshing subcircuit. The driving subcircuit is configured to, in the reset phase in response to the reset voltage of the driving node, be turned on; in the compensation and data refreshing phase, maintain a turned-on state till the voltage of the driving node is the first voltage to turn off the driving subcircuit; and in a light emission driving phase in response to the first voltage, be turned on.

The light emission control subcircuit is connected to the driving subcircuit, the anode node of the light emitting element, the light emission driving voltage input terminal and the light emission driving sequence signal terminal. The light emission control subcircuit is configured to, in the light emission driving phase in response to the light emission driving sequence input by the light emission driving sequence signal terminal, be turned on to write that the light emission driving voltage input by the light emission driving voltage input terminal in the anode node via the driving subcircuit and the light emission control subcircuit to control the light emitting element to emit light.

An embodiment of the present disclosure also provides a display panel which includes any pixel circuit described above.

An embodiment of the present disclosure further provides a display device which includes the display panel described above.

Other aspects will become apparent after accompanying drawings and the detailed description are read and understood.

BRIEF DESCRIPTION OF DRAWINGS

In the drawings, several implementations of the embodiments of the present disclosure are illustrated as examples rather than limitations, and identical or corresponding reference numerals denote identical or corresponding parts.

DETAILED DESCRIPTION

Figure 1:
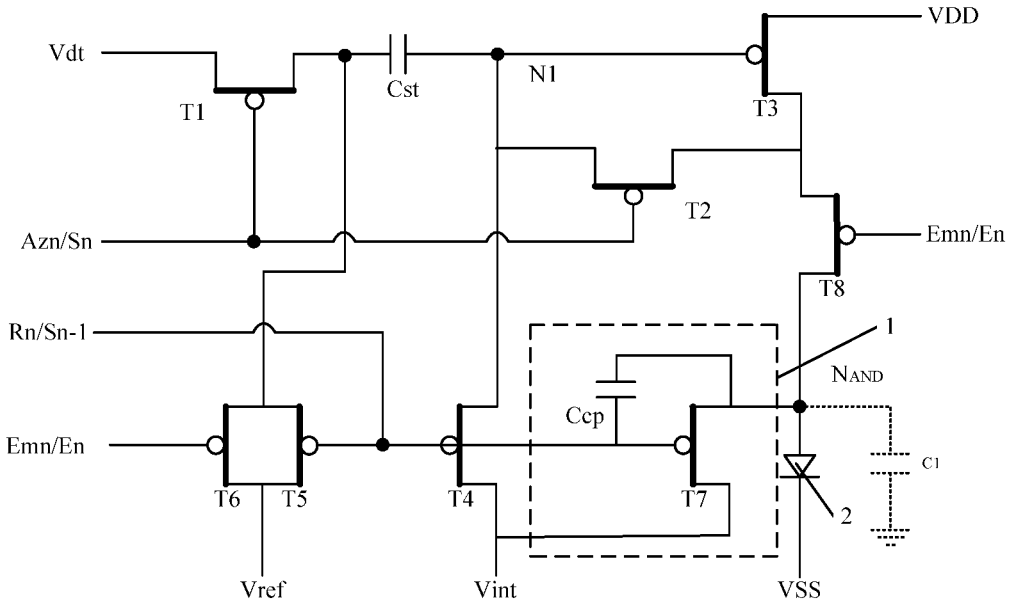
FIG. 1 exemplifies a schematic diagram of a structure of a pixel circuit provided by an embodiment of the present disclosure.

Exemplary implementations of embodiments of the present disclosure will be described below with reference to the accompanying drawings. Although exemplary implementations of the disclosed embodiments are shown in the drawings, it should be understood that the disclosed embodiments may be implemented in various forms and should not be limited by the embodiments set forth herein. These implementations are provided for aims that the embodiments of the present disclosure can be understood more thoroughly and the scope of the embodiments of the present disclosure can be fully conveyed to those skilled in the art.

Unless otherwise stated, the technical terms or scientific terms used in the embodiments of this disclosure shall have general meanings understood by those skilled in the art.

A reset mechanism of resetting a pixel OLED electrode by resetting a TFT has a negative effect. When the pixel circuit finishes a signal refreshing phase, a light emission sequence controls the driving TFT to be turned on to output a current (the TFT here is an abbreviation of the transistor). When the current drives the pixel OLED to emit light, light emission of the OLED is delayed due to influence of the related capacitance of an anode circuit node. The specific reason for the light emission delay is that the initialization reset voltage of the pixel circuit is usually too low, and as a result, charges in the anode node capacitor C1 are substantially released after reset, and the voltage between the two electrodes of the OLED is close to or equal to 0 V; when the pixel circuit finishes the refreshing phase and begins to drive the pixel OLED to emit light, the driving current first charges the anode node capacitor C1 till the anode potential increases and the OLED junction voltage reaches the emission threshold voltage, then the OLED gradually emits light. It takes certain time to charge the anode node capacitor C1. Time required for charging the anode node capacitor C1 to increase the junction voltage of the OLED light emitting element to the emission threshold voltage is the light emission delay. The delay will bring perceptible influence especially for a driving situation of the pixel circuit with low gray scale and small current in a current driving mode.

An embodiment of the present disclosure further provides a pixel circuit which includes a reset subcircuit, a data refreshing subcircuit, a driving subcircuit, a light emission control subcircuit and a potential compensation subcircuit.

The reset subcircuit is connected with a driving node and is configured to reset the driving node.

The data refreshing subcircuit is connected with the driving node and is configured to store a data voltage and control a driving node voltage to be a first voltage.

The driving subcircuit is connected with the driving node and the light emission control subcircuit respectively, and is configured to be turned on or off according to the driving node voltage.

The light emission control subcircuit is connected with a light emitting element, and is configured to write a light emission driving voltage in an anode node of a light emitting element via the driving subcircuit and the light emission control subcircuit.

The potential compensation subcircuit is connected with the light emitting element, and is configured to control a junction voltage of the light emitting element to be within a preset voltage range according to an initial voltage input by an initialization reset voltage terminal and a reset sequence input by a reset sequence signal terminal, wherein the preset voltage range is higher than zero and lower than an emission threshold voltage of the light emitting element.

In an exemplary embodiment, the potential compensation subcircuit is at least connected to an initialization reset voltage terminal and a reset sequence signal terminal, and is configured to, in a reset phase and/or a compensation and data refreshing phase, control a junction voltage of the light emitting element to be within a preset voltage range according to an initial voltage input by the initialization reset voltage terminal and the reset sequence input by the reset sequence signal terminal.

As shown in FIGS. 1-5, the pixel circuit may be connected with the following signal terminals: an initialization reset voltage terminal Vint configured to input an initial voltage, a data voltage input terminal Vdt configured to input a data voltage, a reference voltage input terminal Vref configured to input a reference voltage, a light emission driving voltage input terminal VDD configured to input a light emission driving voltage, a reset sequence signal terminal Rn configured to input a reset sequence, a compensation and refreshing sequence signal terminal AZn configured to input a compensation and refreshing sequence, and a light emission driving sequence signal terminal EMn configured to input a light emission driving sequence.

The pixel circuit includes a reset subcircuit 3, a data refreshing subcircuit 4, a driving subcircuit 5, a light emission control subcircuit 6 and a potential compensation subcircuit 1.

The reset subcircuit 3 is connected to a driving node N1, the initialization reset voltage terminal Vint and the reset sequence signal terminal Rn, and is configured to, in a reset phase in response to the reset sequence, connect the initialization reset voltage terminal Vint to the driving node N1 and reset the driving node N1.

The data refreshing subcircuit 4 is connected to the driving node N1, the compensation and refreshing sequence signal terminal Azn, the light emission driving sequence signal terminal EMn, a reference voltage input terminal Vref and a data voltage input terminal Vdt. The data refreshing subcircuit 4 is configured to, in a compensation and data refreshing phase in response to the compensation and refreshing sequence, write the data voltage in and store the data voltage, and in a light emission driving phase in response to a light emission driving sequence, control the voltage of the driving node N1 to decrease to a first voltage according to the data voltage and the reference voltage.

The driving subcircuit 5 is connected to the driving node N1, the light emission driving voltage input terminal and the data refreshing subcircuit 4. The driving subcircuit 5 is configured to, in a reset phase in response to the reset voltage of the driving node N1, be turned on, in a compensation and data refreshing phase, maintain a turned-on state to allow the light emission driving voltage input terminal to charge the driving node N1 via the driving subcircuit 5 and the data refreshing subcircuit 4 till the voltage of the driving node N1 increases to a second voltage to turn off the driving subcircuit 5; and in the light emission driving phase, be turned on in response to the first voltage.

The light emission control subcircuit 6 is connected to the driving subcircuit 5, an anode node $N_{AND}$ of the light emitting element 2 and the light emission driving sequence signal terminal EMn. The light emission control subcircuit 6 is configured to, in the light emission driving phase in response to the light emission driving sequence, be turned on to write the light emission driving voltage in the anode node $N_{AND}$ via the driving subcircuit 5 and the light emission control subcircuit 6 to control the light emitting element 2 to emit light.

The potential compensation subcircuit 1 is at least connected to the initialization reset voltage terminal Vint and the reset sequence signal terminal Rn. The potential compensation subcircuit 1 is configured to, in a reset phase and/or a compensation and data refreshing phase, control a junction voltage of the light emitting element 2 to be within a preset voltage range according to an initial voltage and the reset sequence, wherein the preset voltage range is higher than zero and lower than an emission threshold voltage of the light emitting element 2.

Multiple pixel circuits may be electrically connected in cascade and arranged in an array. Alternatively, the pixel circuits may be considered as subpixel circuits, and one pixel circuit includes multiple subpixel circuits electrically connected in cascade and arranged in an array. In this disclosure, any one of the circuits in FIGS. 1-8 being one pixel circuit is taken as an example for description.

Figure 2:
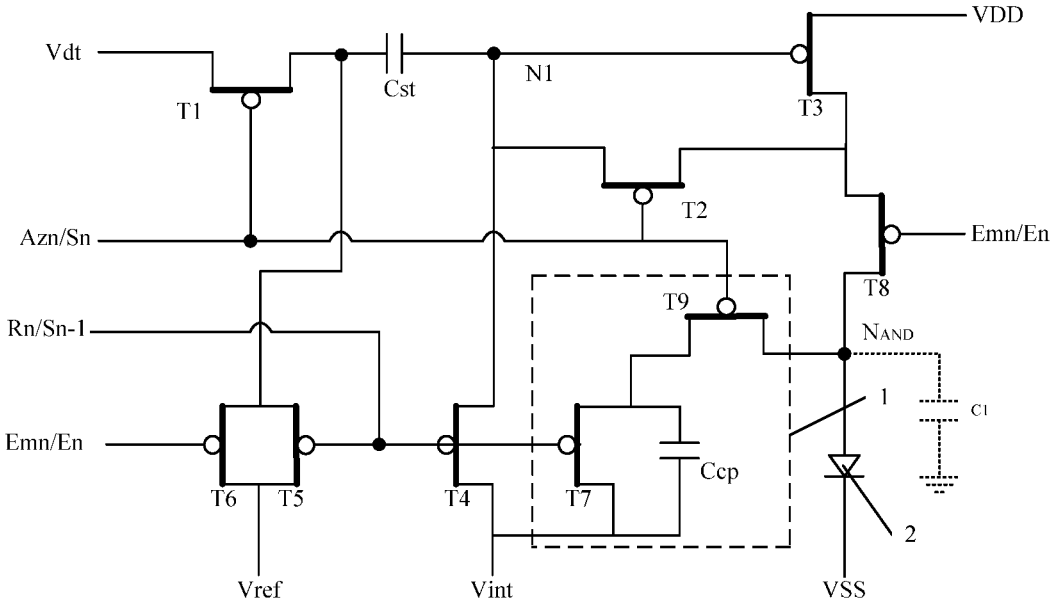
FIG. 2 exemplifies a schematic diagram of another structure of a pixel circuit provided by an embodiment of the present disclosure.
Figure 3:
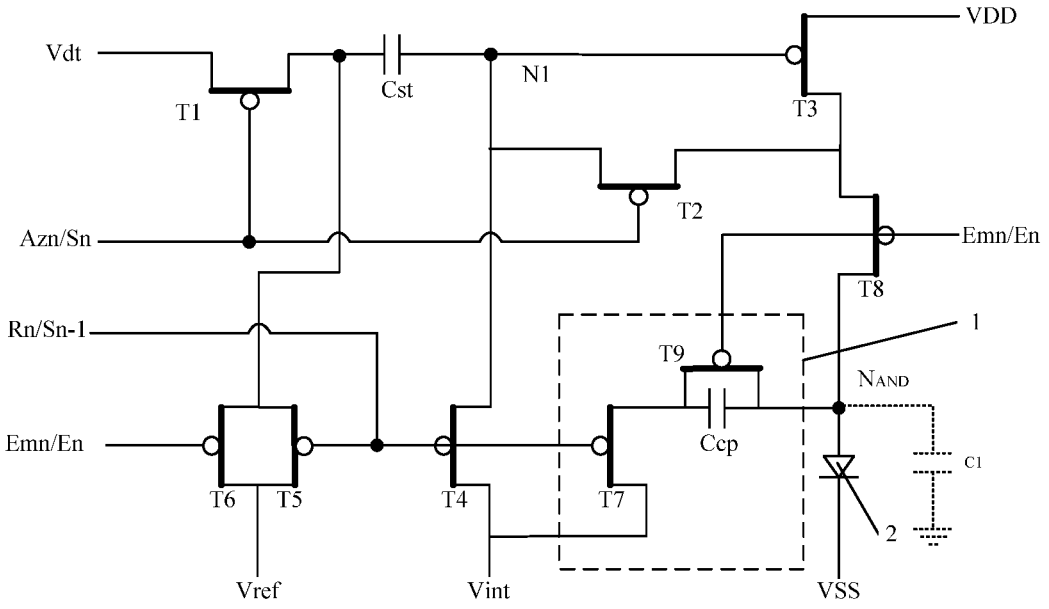
FIG. 3 exemplifies a schematic diagram of yet another structure of a pixel circuit provided by an embodiment of the present disclosure.

In an exemplary embodiment, each pixel circuit corresponds to a light emitting element 2 of a subpixel, the pixel circuit is configured to drive the light emitting element 2 to emit light, and the anode node $N_{AND}$ is connected to the anode of the light emitting element 2. The anode of the light emitting element 2 may be connected to the light emission driving voltage input terminal via the light emission control subcircuit 6 and the driving subcircuit 5 in sequence. The light emission driving voltage terminal may be a high voltage signal terminal VDD while the cathode is connected to a low voltage signal terminal VSS. In a manufacturing process of a display panel, OLED junction capacitance connected to the anode node $N_{AND}$ and parasitic capacitance of an anode circuit node are inevitably formed. Taking OLED junction capacitance as an example, when an OLED element, i.e., the light emitting element 2, is formed, it includes an anode layer, a cathode layer and a light emitting layer between the anode layer and the cathode layer, and a capacitance formed by the anode and the cathode is the OLED junction capacitance. For ease of description, in the following, the junction capacitance and the parasitic capacitance of the anode circuit node are collectively referred to as anode node capacitance C1, and as shown in FIGS. 1-3, capacitance C1 is the anode node capacitance.

A light emission period of the light emitting element 2 includes a reset phase, a compensation and data refreshing phase and a light emission driving phase. A process where the pixel circuit drives the light emitting element 2 to emit light includes: in the reset phase, the reset sequence signal terminal Rn inputs an effective signal to the pixel circuit and the reset subcircuit 3 resets the driving node N1, the reset driving node N1 having an initial voltage, that is, the reset voltage of the driving node N1 being equal to the initial voltage, after the driving node N1 is reset, the reset voltage of the driving node N1 may control the driving subcircuit 5 to be turned on; in the compensation and data refreshing phase, the compensation and refreshing sequence signal terminal AZn inputs an effective signal, at this time the data voltage can be written in and stored in the data refreshing subcircuit 4, and the driving subcircuit 5 is connected to the driving node N1 via part of the data refreshing subcircuit 4 to write the light emission driving voltage in the driving node N1 via the driving subcircuit 5 and the data refreshing subcircuit 4 and to charge the driving node N1, so that the voltage of the driving node N1 gradually increases. When the voltage of the driving node N1 increases to the second voltage, the driving subcircuit 5 is turned off in response to the second voltage, and the light emission driving voltage input terminal stops charging the driving node N1. In the light emission driving phase, the light emission driving sequence signal terminal EMn inputs an effective signal, i.e., the light emission driving sequence is the effective signal, in response to the light emission driving sequence the data refreshing subcircuit 4 can write a reference voltage, which is a negative value, in, so that the voltage stored in the data refreshing subcircuit 4 decreases, and further causes the voltage of the driving node N1 to decrease to a first voltage which turns the driving subcircuit 5 on again and turns the light emission control subcircuit 6 on, and then the light emission driving voltage input terminal is connected to the anode node via the driving subcircuit 5 and the light emission control subcircuit 6 in sequence to increase the voltage of the anode node NAND, so that the light emitting element 2 emits light.

In some technologies, the reset subcircuit 3 is required to reset anode node $N_{AND}$ in the reset phase to clear the charges in the anode node capacitor C1 so as to effectively prevent a noise current. When residual charges in anode node capacitor C1 are excessive, the residual charges will be discharged via light emitting element 2, causing uncontrolled light emission. At this time, as the reset subcircuit 3 resets the anode node $N_{AND}$, the junction voltage of light emitting element 2 is close to or equal to 0 V and the amount of charges in anode node capacitor C1 is close to or equal to zero. The junction voltage of the light emitting element 2 refers to a voltage value of the anode node of the light emitting element relative to a cathode voltage. In the light emission driving phase, the light emission driving voltage input terminal VDD is connected to the anode node $N_{AND}$ to charge the anode node capacitor C1, so that the voltage of the anode node $N_{AND}$ and the junction voltage of the light emitting element 2 gradually increase. When the junction voltage of the light emitting element 2 reaches the emission threshold voltage Vth and above, the light emitting element 2 can emit light. Before the junction voltage reaches to Vth, the light emitting element 2 does not emit light. In this process, the smaller the current is, the longer the time required for charging the capacitor is, i.e. the longer the time for the junction voltage of the light emitting element 2 to reach the emission threshold voltage, which leads to the light emission delay. The delay is obvious especially when the pixel is driven by a small current to emit light. In this embodiment, to solve the above-mentioned issue of light emission delay, a potential compensation subcircuit 1 is designed in the pixel circuit. The potential compensation subcircuit may be connected to the initialization reset voltage terminal Vint and the reset sequence signal terminal Rn, and can control the junction voltage of the light emitting element 2 to maintain within a preset voltage range in a non-light emission phase according to the reset sequence signal of the reset sequence signal terminal Rn and the initial voltage of the initialization reset voltage terminal Vint. Herein the preset voltage range is higher than zero and lower than the emission threshold voltage Vth of the light emitting element 2, and the initialization reset voltage terminal Vint is the initialization reset voltage terminal of the pixel circuit. The non-light emission phase includes a reset phase and a compensation and data refreshing phase. In this embodiment, assume the junction voltage of the light emitting element 2 is V1 in the non-light emission state, $0<V1<Vth$, and there are still some charges in the anode node capacitor C1. When the driving subcircuit 5 and the light emission control subcircuit 6 drive the light emitting element 2 to emit light, the driving current enters the anode node capacitor C1 and acts together with the original charges in the anode node capacitor C1 to increase the junction voltage of the light emitting element 2 to the emission threshold voltage Vth in a short time, so that the light emitting element 2 emits light in a short time. The time for the junction voltage of the light emitting element 2 to increase from V1 to Vth is referred to as pre-emission time. In a case where the current remains the same, the smaller a voltage difference between Vth and V1 is, the shorter the pre-emission time is. In some technologies, after the light emission driving phase ends and the anode node $N_{AND}$ is reset, the junction voltage of the light emitting element 2 is zero. Therefore, once again in the light emission driving phase, the junction voltage of the light emitting element 2 needs to increase from zero to Vth. But V1 is higher than zero and lower than the emission threshold voltage Vth of the light emitting element 2 in the embodiment of the present disclosure, so the pre-emission time in the embodiment of the present disclosure is shorter, which can mitigate the light emission delay without causing the uncontrolled light emission of the light emitting component due to charge discharge. In an embodiment of the present disclosure, the junction voltage of the light emitting element 2 may be maintained within a preset voltage range in the reset phase or the compensation and data refreshing phase. In an embodiment, the potential compensation subcircuit 1 is connected to the original circuit in the pixel circuit, and the initialization reset voltage terminal Vint needs to be connected to the potential compensation subcircuit 1, and may be configured to reset a power storage element Cst in the pixel circuit, while in addition to being used for the potential compensation subcircuit 1, the reset sequence signal terminal Rn may provide an effective signal in the reset phase to drive the reset of the power storage element Cst which may be a capacitor. In some technologies, a new reset power supply is introduced to provide a reset voltage for nodes. As different nodes requires different reset voltages, in order to optimize the effect of resets for these nodes respectively, multiple power supply reset circuits are required to control the reset voltages of different pixel circuits, which, however, results in complicated circuits. In the present embodiment, there is no need to introduce new power supply voltages or to add new signal wires or reset power supplies, and thus, the pixel circuits are simplified.

According to the pixel circuit provided by the embodiment of the disclosure, by controlling the junction voltage of the light emitting element to maintain within the preset voltage range in the reset phase and/or the compensation and data refreshing phase, a part of charges can be reserved in the anode node capacitor, and when the light emitting element is driven to emit light, the driving current enters the anode node capacitor to act together with the original charges in the anode node capacitor to increase the junction voltage of the light emitting element to the emission threshold voltage in a short time, so that the light emitting element emits light in a short time, which avoids the light emission delay, and as the preset voltage range is lower than the emission threshold voltage of the light emitting element, uncontrolled light emission will not occur.

In some exemplary embodiments, optionally, as shown in FIG. 1, the potential compensation subcircuit 1 includes a reset transistor T7 and a compensation capacitor Ccp. A gate of the reset transistor T7 is electrically connected to the reset sequence signal terminal Rn; a first electrode of the reset transistor T7 is electrically connected to the initialization reset voltage terminal Vint; and a second electrode of the reset transistor T7 is electrically connected to the anode node $N_{AND}$. A first electrode plate of the compensation capacitor Ccp is electrically connected to the reset sequence signal terminal Rn, and the second electrode plate of the compensation capacitor Ccp is electrically connected to the anode node $N_{AND}$.

The compensation capacitor Ccp is always connected in series with the anode node capacitor C1. In the reset phase, the reset sequence signal terminal Rn will provide an effective signal, i.e., a low-level signal Vgl. After receiving the effective signal, the reset transistor T7 is turned on to connect the initialization reset voltage terminal Vint to the anode node $N_{AND}$, at this time the initial voltage is written in the anode node $N_{AND}$, the anode node $N_{AND}$ is thus reset, so that the junction voltage of the light emitting element 2 becomes zero. Then, as the reset phase ends and the compensation and data refreshing phase starts, a level of the reset sequence gradually increases from a low level signal Vgl to a high level signal, during this level increasing process the level of the reset sequence reaches the threshold voltage Vsth of the reset transistor T7 first to turn the reset transistor T7 off, and then continues to increase until reaching a high level signal Vgh. In a process of the level of the reset transistor T7 increasing from the threshold voltage Vsth to Vgh, the compensation capacitor Ccp causes the junction voltage of the light emitting element 2 to increase to the preset voltage range, and as the compensation capacitor Ccp is connected in series with the anode node capacitor C1, the junction voltage of the light emitting element 2 is calculated according to the principle of voltage distribution in series connection. The junction voltage of the light emitting element 2 does not rise with the increase of the voltage of the first electrode plate of the compensation capacitor Ccp until the reset sequence voltage reaches the threshold voltage of the reset transistor T7. In the present embodiment, the junction voltage of the light emitting element 2 may be maintained within the preset voltage range during the compensation and data refreshing phase. When the anode node $N_{AND}$ is determined, a capacitance value of the compensation capacitor Ccp may be calculated according to the following formula (1).

$$V_{AND} = \frac{C_{cp}(V_{gh} - V_{sth})}{C_{cp} + C_{AND}} + V_{INT} \tag{1}$$

In the above formula (1), $V_{AND}$ is the voltage of the anode node $N_{AND}$; $C_{cp}$ is the capacitance value of the compensation capacitor; $C_{AND}$ is the capacitance value of the anode node capacitor C1, $V_{INT}$ is the initial voltage. Since the cathode voltage VSS of the light emitting element 2 is determined and the junction voltage V1 of the light emitting element 2 is equal to $V_{AND}$−VSS, the junction voltage of the light emitting element 2 may be controlled by controlling the voltage of the anode node $N_{AND}$. In the present embodiment, the reset sequence signal terminal Rn serves as the reset power supply, that is, the voltage signal input by the reset sequence signal terminal Rn can be written in the first electrode plate of the compensation capacitor Ccp. The reset sequence signal terminal Rn can not only control switch of transistors in the pixel circuit but also raise the voltage of anode node $N_{AND}$. In some technologies, the sequence signal terminal can only be used for control the transistors to be turned on or off, the voltage signal input from the sequence signal terminal will not be written in the two terminals of the capacitor or the anode node or the like, for example, the reset sequence signal terminal Rn, the compensation and refreshing sequence signal terminal AZn and the light emission driving sequence signal terminal EMn are all sequence signal terminals, which are not enumerated here.

In an exemplary embodiment, the potential compensation subcircuit 1 may be electrically connected to a preset sequence signal terminal which is configured to input a preset sequence, and in this case the potential compensation subcircuit is configured to control the junction voltage of the light emitting element to be within the preset voltage range according to the preset sequence, the initial voltage and the reset sequence.

Optionally, as shown in FIG. 2, the preset sequence signal terminal is the compensation and refreshing sequence signal terminal AZn, the preset sequence is the compensation and refreshing sequence, and the potential compensation subcircuit 1 includes a reset transistor T7, a compensation transistor T9 and a compensation capacitor Ccp. A gate of the reset transistor T7 is electrically connected to the reset sequence signal terminal Rn, a first electrode of the reset transistor T7 is electrically connected to the initialization reset voltage terminal Vint, and a second electrode of the reset transistor T7 is electrically connected to a first electrode of the compensation transistor T9 and a first electrode plate of the compensation capacitor Ccp. A gate of the compensation transistor T9 is electrically connected to the compensation and refreshing sequence signal terminal AZn, and a second electrode of the compensation transistor T9 is electrically connected to the anode node $N_{AND}$. A second electrode plate of the compensation capacitor Ccp is electrically connected to the initialization reset voltage terminal Vint.

Figure 4:
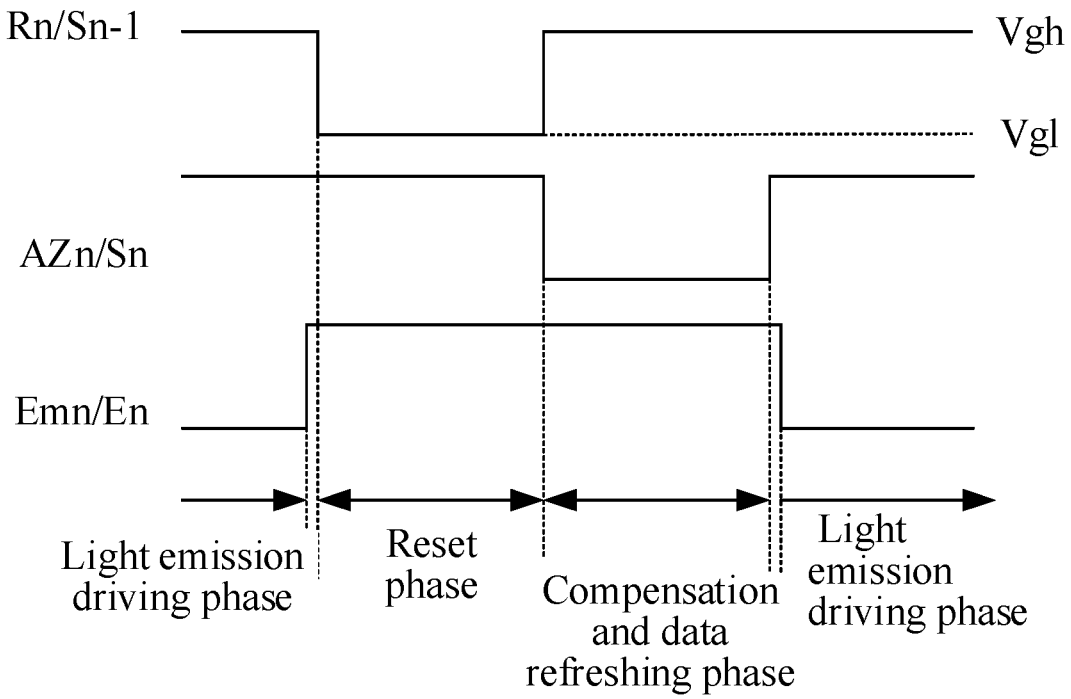
FIG. 4 exemplifies a schematic diagram of timing of a pixel circuit provided by an embodiment of the present disclosure.
Figure 5:
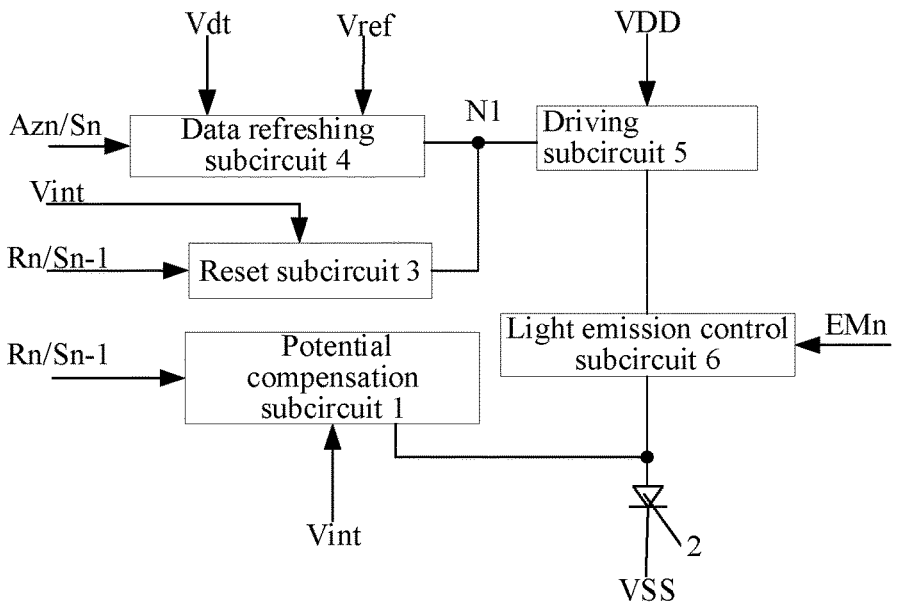
FIG. 5 exemplifies a schematic diagram of a structure of a pixel circuit provided by an embodiment of the present disclosure.
Figure 6:
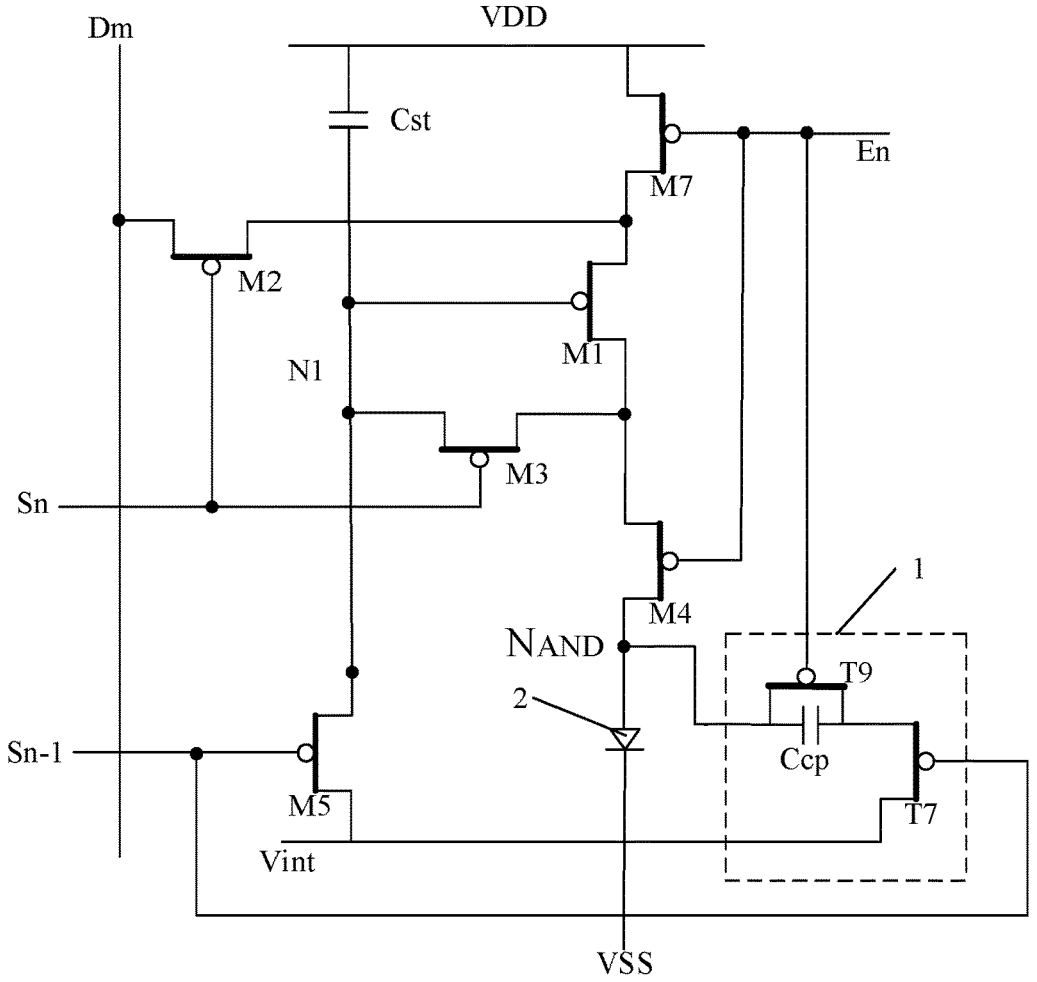
FIG. 6 exemplifies a schematic diagram of another structure of a pixel circuit provided by an embodiment of the present disclosure.
Figure 7:
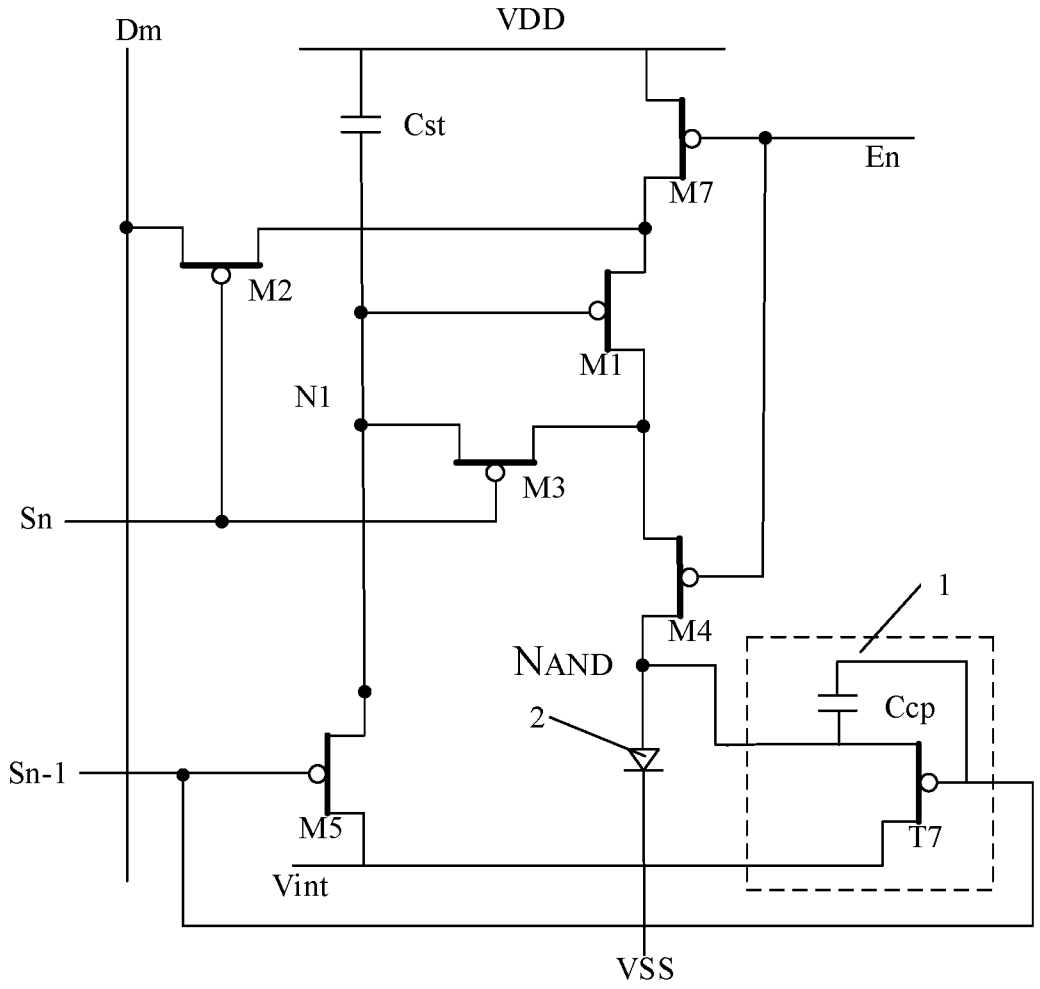
FIG. 7 exemplifies a schematic diagram of yet another structure of a pixel circuit provided by an embodiment of the present disclosure.
Figure 8:
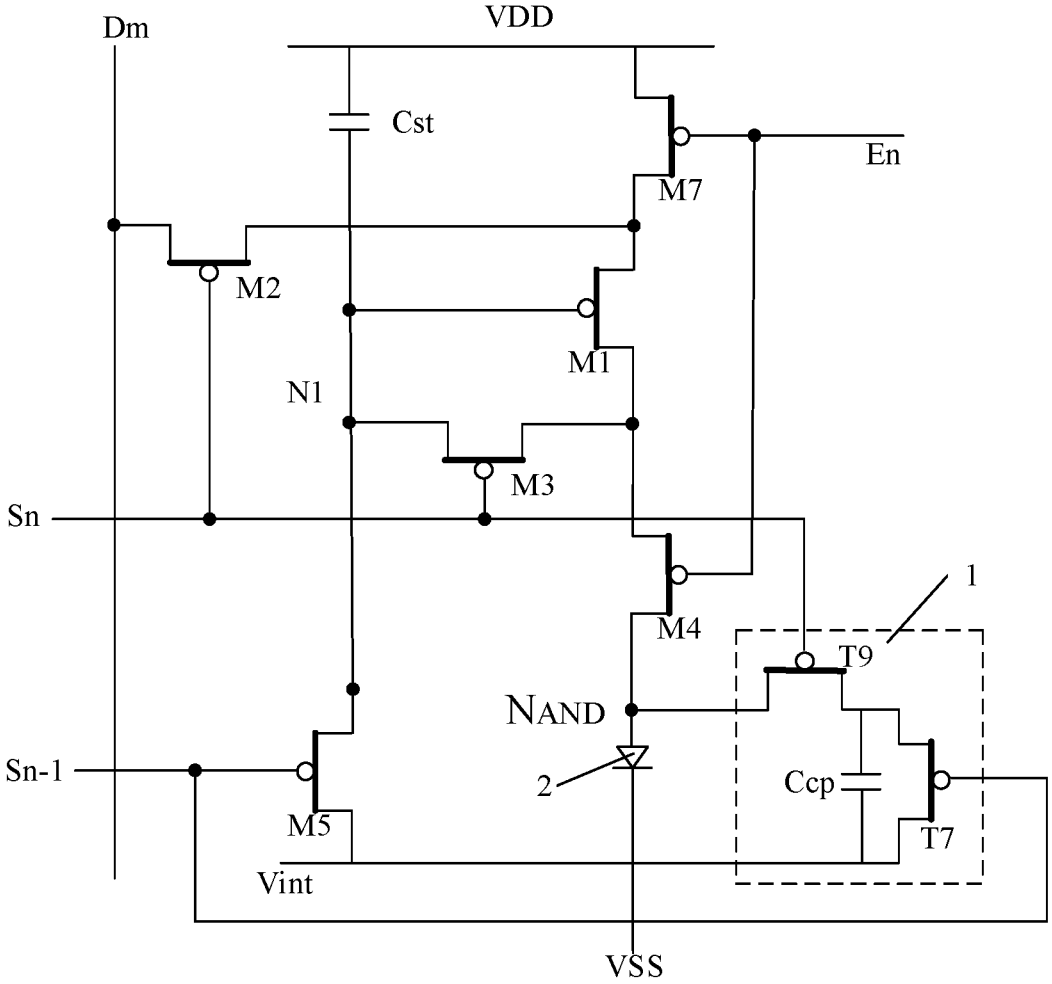
FIG. 8 exemplifies a schematic diagram of yet another structure of a pixel circuit provided by an embodiment of the present disclosure.
Figure 9:
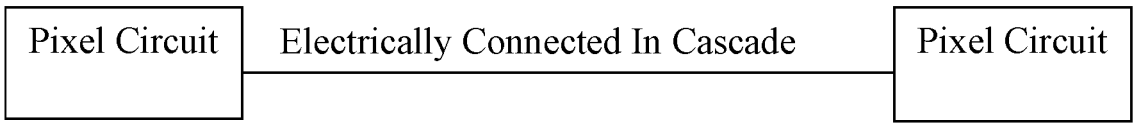
FIG. 9 exemplifies a schematic diagram of pixel circuits electrically connected in cascade provided by an embodiment of the present disclosure.
Figure 10:
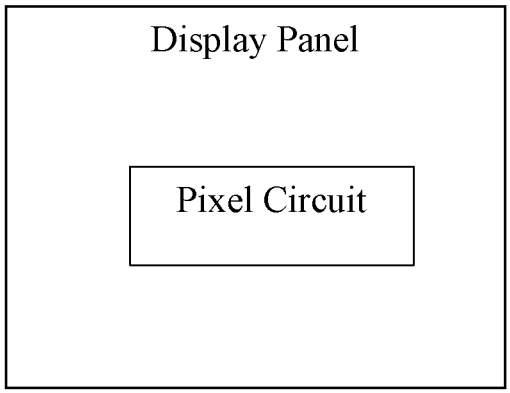
FIG. 10 exemplifies a schematic diagram of a structure of a display panel provided by an embodiment of the present disclosure.
Figure 11:
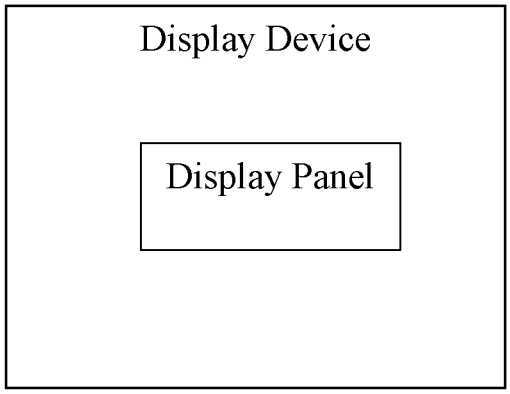
FIG. 11 exemplifies a schematic diagram of a structure of a display device provided by an embodiment of the present disclosure.

As shown in FIG. 4, when the pixel circuit enters the reset phase, the reset sequence signal terminal Rn inputs an effective low potential signal to the pixel circuit, and the reset transistor T7 receives the low potential signal to turn the first electrode and the second electrode of the reset transistor T7 on; at this time, the first electrode plate of the compensation capacitor Ccp can be connected to the initialization reset voltage terminal Vint, and since the second electrode plate of the compensation capacitor Ccp is always connected to the initialization reset voltage terminal Vint, the reset transistor T7 resets the compensation capacitor Ccp during the reset phase and the amount of charges in the compensation capacitor Ccp is zero. When the pixel circuit enters the compensation and data refreshing phase from the reset phase, the potential of the reset sequence increases from low potential to high potential. In the compensation and data refreshing phase, a signal sent by the reset sequence is an invalid signal while the signal of the compensation and refreshing sequence changes from invalid to effective as the potential of the compensation and refreshing sequence changes from the high potential to the low potential, at this time the reset transistor T7 is turned off and the gate of the compensation transistor T9 receives a low potential effective signal which turns the first electrode and the second electrode of the compensation transistor T9 on to connect the first electrode plate of the compensation capacitor Ccp to the anode node $N_{AND}$. The compensation capacitor Ccp is thus connected in series with the anode node capacitor C1, which allows the compensation capacitor Ccp to balance the charges in the anode node capacitor C1 and reduce the charges in the anode node capacitor C1 but not to zero, thereby lowering the junction voltage of the light emitting element 2. In the present embodiment, the junction voltage of the light emitting element 2 can be maintained within the preset voltage range in the compensation and data refreshing phase. The junction voltage of the light emitting element 2 is related to the capacitance value of the compensation capacitor Ccp and the capacitance value of the anode node capacitor C1. According to the principle of charge conservation, the capacitance value of the compensation capacitor Ccp may be calculated according to the junction voltage of the light emitting element 2 and the capacitance value of the anode node capacitance C1. Optionally, in the present embodiment, the capacitance value of the compensation capacitor Ccp may be calculated according to the following formula (2).

$$V_{AND} = \frac{C_{cp}V_{INT} + C_{AND}V_{AND0}}{C_{cp} + C_{AND}} \tag{2}$$

In the above formula (2), $V_{AND0}$ is a $N_{AND}$ voltage before the NAND voltage is compensated to be $V_{AND}$.

Optionally, as shown in FIG. 3, the preset sequence signal terminal is the light emission driving sequence signal terminal EMn and the preset sequence is the light emission driving sequence. The potential compensation subcircuit 1 includes a reset transistor T7, a compensation transistor T9 and a compensation capacitor Ccp. A gate of the reset transistor T7 is electrically connected to the reset sequence signal terminal Rn; a first electrode of the reset transistor T7 is electrically connected to the initialization reset voltage terminal Vint; and a second electrode of the reset transistor T7 is electrically connected to a first electrode of the compensation transistor T9 and to a first electrode plate of the compensation capacitor Ccp. A gate of the compensation transistor T9 is electrically connected to the light emission driving sequence signal terminal EMn, and the second electrode of the compensation transistor T9 is electrically connected to the anode node $N_{AND}$. A second electrode plate of the compensation capacitor Ccp is electrically connected to the anode node $N_{AND}$.

When the pixel circuit is in the light emission driving phase, the light emission driving sequence input by the light emission driving sequence signal terminal EMn is a low potential and is an effective signal. At this time, the compensation transistor T9 receives the low potential effective signal, and the first electrode and the second electrode of the compensation transistor T9 are turned on and thus short the compensation capacitor Ccp, so that the voltage difference between the two terminal of the compensation capacitor Ccp becomes zero. Therefore, in the light emission driving phase, the amount of charges in the compensation capacitor Ccp is zero. When the pixel circuit enters the reset phase from the light emission driving phase, as the light emission driving sequence changes from the low potential to the high potential, from the effective signal to the ineffective signal, in the reset phase the compensation transistor T9 is turned off and the reset sequence changes from the high potential to the low potential, from the ineffective signal to the effective signal, the gate of the reset transistor T7 receives the low potential effective signal, and the first and second electrodes of the reset transistor T7 are turned on, so that the compensation capacitor Ccp is connected in series with the anode node capacitor C1 connected to the anode node $N_{AND}$, and the charges in the anode node capacitor C1 redistributes and partially enters the compensation capacitor Ccp. As the charges in the anode node capacitor C1 decreases, the voltage of the anode node $N_{AND}$ decreases. As the voltages are distributed between two capacitors connected in series, the capacitance value of the compensation capacitor Ccp may be calculated according to the capacitance value of the anode node capacitance C1 and the voltage of the anode node $N_{AND}$. In the present embodiment, the junction voltage of the light emitting element 2 can be maintained within the preset voltage range during the reset phase and the compensation and data refreshing phase. The relationship between the value of the anode node capacitance C1 and the value of the compensation capacitance Ccp is shown by the following formula (3).

$$V_{AND} = \frac{C_{cp}V_{INT} + C_{AND}V_{AND0}}{C_{cp} + C_{AND}} \tag{3}$$

Optionally, the driving subcircuit 5 includes a third transistor T3, and the light emission control subcircuit 6 includes an eighth transistor T8. A gate of the third transistor T3 is electrically connected to the driving node N1, a first electrode of the third transistor T3 is electrically connected to the light emission driving voltage input terminal, a second electrode of the third transistor T3 is electrically connected to the first electrode of the eighth transistor T8. A gate of the eighth transistor is electrically connected to the light emission driving sequence signal terminal, and a second electrode of the eighth transistor is electrically connected to the anode node.

Optionally, the data refreshing subcircuit 4 includes a power storage element Cst, a first transistor T1, a second transistor T2 and a sixth transistor T6. A second electrode plate of the power storage element Cst is electrically connected to the driving node N1. A gate of the first transistor T1 is electrically connected to the compensation and refreshing sequence signal terminal AZn, a first electrode of the first transistor T1 is electrically connected to the data voltage input terminal, and a second electrode of the first transistor T1 is electrically connected to the first electrode plate of the power storage element Cst. A gate of the second transistor T2 is electrically connected to the compensation and refreshing sequence signal terminal AZn, a first electrode of the second transistor T2 is connected to the second electrode of the third transistor T3, and a second electrode of the second transistor T2 is connected to the driving node N1. A gate of the sixth transistor T6 is electrically connected to the light emission driving sequence signal terminal EMn, a first electrode of the sixth transistor T6 is electrically connected to the reference voltage input terminal Vref, and a second electrode of the sixth transistor T6 is electrically connected to the first electrode plate of the power storage element Cst.

Optionally, the reset subcircuit 3 includes a fifth transistor T5 and a fourth transistor T4. A gate of the fifth transistor T5 is electrically connected to the reset sequence signal terminal Rn, a first electrode of the fifth transistor T5 is electrically connected to the reference voltage input terminal Vref, and a second electrode of the fifth transistor T5 is electrically connected to the first electrode plate of the power storage element Cst. A gate of the fourth transistor T4 is electrically connected to the reset sequence signal terminal Rn, a first electrode of the fourth transistor T4 is electrically connected to the initialization reset voltage terminal, and a second electrode of the fourth transistor T4 is electrically connected to the driving node N1.

The power storage element Cst may be a capacitor. When the pixel circuit is in the reset phase, the reset sequence input by the reset sequence signal terminal Rn may be a low potential effective signal, at this time the fifth transistor T5 is turned on to electrically connect the reference voltage input terminal Vref to the first electrode plate of the power storage element Cst, so that the voltage of the first electrode plate of the power storage element Cst is maintained at the reference voltage. Meanwhile, the first electrode and the second electrode of the fourth transistor T4 are turned on to electrically connect the initialization reset voltage terminal Vint to the second electrode plate of the power storage element Cst, i.e., the driving node N1, to reset the power storage element Cst. A gate of the third transistor T3 is electrically connected to N1, and the reset voltage of N1 can turn the third transistor T3 which may be a driving transistor on.

When the pixel circuit is in the compensation and data refreshing phase, the fifth transistor T5 and the fourth transistor T4 are turned off while the second transistor T2 and the third transistor T3 are turned on, and therefore, the light emission driving voltage input terminal charges the N1 node via the third transistor T3 and the second transistor T2 to gradually increase the voltage of the N1 node. When the voltage of the N1 node increases to the second voltage which exceeds the threshold voltage of the third transistor T3, the third transistor T3 is turned off. The light emission driving voltage input terminal is a high voltage signal input terminal VDD, that is, the light emission driving voltage input terminal is used for inputting a high voltage. Furthermore, the first transistor T1 is turned on to connect the data voltage input terminal Vdt to the first electrode plate of the power storage element Cst, so that the data voltage Vdata input by the data voltage input terminal Vdt is written in the first voltage plate of the power storage element Cst.

When the pixel circuit is in the light emission driving phase, the first transistor T1 and the second transistor T2 are turned off, the light emission driving sequence input by the light emission driving sequence signal terminal EMn is a low level effective signal, and the sixth transistor T6 is turned on, so that the reference voltage input terminal Vref is electrically connected to the first electrode plate of the power storage element Cst, and at this time the reference voltage input terminal Vref is written in the first electrode plate of the power storage element Cst, the voltage of which decreases from the data voltage Vdata to the reference voltage, and thereby the voltage of the N1 node decreases by Vdata-Vref. The third transistor T3 receives the low voltage signal of N1 node, and is turned on. The eighth transistor T8 receives the low potential effective signal of the light emission driving sequence, and is turned on. Thus, the light emission driving voltage input by the light emission driving voltage input terminal, i.e., the high voltage signal VDD, is written in the anode node $N_{AND}$ of the light emitting element 2 and charges the anode node $N_{AND}$ via the third transistor T3 and the eighth transistor T8, so that the junction voltage of the anode node $N_{AND}$ increase gradually to increase the junction voltage of the light emitting element 2. When the junction voltage of the light emitting element 2 increases to the emission threshold voltage, the light emitting element 2 can emit light.

In one light emission period, the reset sequence signal terminal Rn, the compensation and refreshing sequence signal terminal AZn, and the light emission driving sequence signal terminal EMn input valid signals to the circuit in turn. The compensation and refreshing sequence signal terminal AZn may be referred to as a scanning sequence signal terminal Sn, and the light emission driving sequence signal terminal EMn may be referred to as En. The potential compensation subcircuit 1 in the embodiment of this disclosure may be applied to other pixel circuits in addition to the above circuits, such as the circuits illustrated in FIGS. 6, 7 and 8.

As shown in FIGS. 5, 6, 7 and 8, the pixel circuit includes a reset subcircuit, a data refreshing subcircuit, a driving subcircuit, a light emission control subcircuit and a potential compensation subcircuit.

The reset subcircuit is connected to a driving node N1, an initialization reset voltage terminal Vint and a reset sequence signal terminal (i.e. the scanning signal terminal Sn−1 in the pixel circuit at the previous stage), and is configured to, in a reset phase in response to a reset sequence input by the reset sequence signal terminal Rn, connect the initialization reset voltage terminal Vint to the driving node N1 and reset the driving node N1.

The data refreshing subcircuit is connected to the driving node N1, the compensation and refreshing sequence signal terminal (Sn in FIGS. 5, 6, 7 and 8), the light emission driving sequence signal terminal VDD, and a data voltage input terminal (Dm in FIGS. 5, 6, 7 and 8). The data refreshing subcircuit is configured to, in the compensation and data refreshing phase in response to the compensation and refreshing sequence input by the compensation and refreshing sequence signal terminal Sn, write the data voltage input by the data voltage input terminal Vdt in and store the data voltage till the voltage of the driving node N1 is the first voltage.

The driving subcircuit is connected to the driving node N1, the light emission control subcircuit and the data refreshing subcircuit. The driving subcircuit is configured to, in a reset phase be turned on in response to the reset voltage of the driving node N1; in a compensation and data refreshing phase, maintain a turned-on state till the voltage of the driving node N1 is the first voltage to turn off the driving subcircuit; and in a light emission driving phase, be turned on in response to the first voltage.

The light emission control subcircuit is connected to the driving subcircuit, an anode node NAND of the light emitting element, a light emission driving voltage input terminal VDD and the light emission driving sequence signal terminal (En in FIGS. 5, 6, 7 and 8). The light emission control subcircuit is configured to, in the light emission driving phase in response to the light emission driving sequence input by the light emission driving sequence signal terminal En, be turned on to write the light emission driving voltage input by the light emission driving voltage input terminal VDD in the anode node $N_{AND}$ via the driving subcircuit and the light emission control subcircuit to control the light emitting element to emit light.

The potential compensation subcircuit is at least connected to the initialization reset voltage terminal and the reset sequence signal terminal. The potential compensation subcircuit is configured to, in the reset phase and/or the compensation and data refreshing phase, control a junction voltage of the light emitting element to be within a preset voltage range according to an initial voltage input by the initialization reset voltage terminal and the reset sequence input by the reset sequence signal terminal, wherein the preset voltage range is higher than zero and lower than an emission threshold voltage of the light emitting element.

Optionally, the reset subcircuit includes a fifteenth transistor M5. A gate of the fifteenth transistor M5 is electrically connected to the reset sequence signal terminal (Sn−1 in FIGS. 5, 6, 7 and 8), a first electrode of the fifteenth transistor M5 is electrically connected to the initialization reset voltage terminal Vint, and a second electrode of the fifteenth transistor M5 is electrically connected to the driving node N1.

Optionally, the data refreshing subcircuit includes a power storage element Cst, a twelfth transistor M2 and a thirteenth transistor M3.

A first electrode plate of the power storage element Cst is electrically connected to the light emission driving voltage input terminal VDD, and a second electrode plate of the power storage element Cst is electrically connected to the driving node N1.

A gate of the twelfth transistor M2 is electrically connected to the compensation and refreshing sequence signal terminal Sn, a first electrode of the twelfth transistor M2 is electrically connected to the data voltage input terminal Dm, and a second electrode of the twelfth transistor M2 is electrically connected to the driving subcircuit (a first electrode of an eleventh transistor M1) and the light emission control subcircuit (a first electrode of a seventeenth transistor M7).

A gate of the thirteenth transistor M3 is electrically connected to the compensation and refreshing sequence signal terminal Sn, a first electrode of the thirteenth transistor M3 is electrically connected to the driving node N1, and a second electrode of the thirteenth transistor M3 is electrically connected to the driving subcircuit (a second electrode of the eleventh transistor M1) and the light emission control subcircuit (a second electrode of a fourteenth transistor M4).

Optionally, the driving subcircuit includes an eleventh transistor M1. A gate of the eleventh transistor M1 is electrically connected to the driving node N1, a first electrode of the eleventh transistor M1 is electrically connected to the data refreshing subcircuit (a second electrode of the twelfth transistor) and the light emission control subcircuit (a second electrode of a seventeenth transistor), and a second electrode of the eleventh transistor M1 is electrically connected to the data refreshing subcircuit (a second electrode of the thirteenth transistor) and the light emission control subcircuit (a second electrode of a fourteenth transistor).

Optionally, the light emission control subcircuit includes a fourteenth transistor M4 and a seventeenth transistor M7.

A gate of the fourteenth transistor M4 is electrically connected to the light emission driving sequence signal terminal En, a first electrode of the fourteenth transistor M4 is electrically connected to the anode node $N_{AND}$, and a second electrode of the fourteenth transistor M4 is electrically connected to the second electrode of an eleventh transistor M1.

A gate of the seventeenth transistor M7 is electrically connected to the light emission driving sequence signal terminal En, a first electrode of the seventeenth transistor M7 is electrically connected to the light emission driving voltage input terminal VDD, and a second electrode of the seventeenth transistor M7 is electrically connected to a first electrode of the eleventh transistor M1.

The potential compensation subcircuit may be any one of the potential compensation subcircuits in the previous embodiments. The connection and working process of the potential compensation subcircuit has been explained in the previous description, which is not repeated here.

One light emission period of the light emitting element 2 includes a reset phase, a compensation and data refreshing phase and a light emission driving phase. The working process is as follows.

In the reset phase, as the reset sequence signal terminal (Sn−1 in the figures) inputs an effective signal to the pixel circuit, the fifteenth transistor M5 is turned on to charge the power storage element Cst; the reset subcircuit resets the driving node N1, and then the driving node N1 has an initial voltage, that is, the reset voltage of the driving node N1 is equal to the initial voltage.

In the compensation and data refreshing phase, as the compensation and refreshing sequence signal terminal (Sn in the figures) inputs an effective signal, the twelfth transistor M2 and the thirteenth transistor M3 are turned on, and at this time a data voltage input by the data voltage input terminal (Dm in FIGS. 5, 6, 7 and 8) may be written into the driving subcircuit; the power storage element Cst starts to discharge to increase the voltage of the signal of the driving node N1 continuously till the voltage of the driving node N1 equals to Vd+Vth (Vd is the data voltage and Vth is a threshold voltage of M1), and the driving subcircuit is thus turned off in response to the voltage of the driving node N1 and the data voltage.

In the light emission driving phase, as the light emission driving sequence signal terminal (En in FIGS. 5, 6, 7 and 8) inputs an effective signal, the fourteenth transistor M4 and the seventeenth transistor M7 are turned on, and at this time the driving subcircuit is directly connected to the light emission driving voltage input terminal VDD, and the voltage of the driving node N1 turns the driving subcircuit on again, the light emission driving voltage input terminal VDD can be connected to the anode node via the driving subcircuit and the light emission control subcircuit, so that the voltage of the anode node $N_{AND}$ increases and the light emitting element 2 emits light.

In an exemplary embodiment, multiple pixel circuits are electrically connected in cascade, and the reset sequence signal terminal Rn of the pixel circuit at the present stage is the compensation and refreshing sequence signal terminal Azn of the pixel circuit at a previous stage.

The reset sequence signal terminal Rn to which the pixel circuit of the present stage is connected may be the compensation and refreshing sequence signal terminal AZn in a pixel circuit of a previous stage, that is, the reset sequence signal terminal Rn to which the pixel circuit of the present stage is connected may be the scanning signal terminal Sn−1 in the pixel circuit of the previous stage. Therefore, the reset sequence signal terminal Rn in the pixel circuit of the present stage and the compensation and refreshing sequence signal terminal AZn in the pixel circuit of a previous stage may share one signal terminal, and multiple pixel circuits in cascade can reduce the complexity of the circuit.

An embodiment of the present disclosure also provides a display panel which includes a pixel circuit provided by any one of the above embodiments, and thus, the display panel provided by the present embodiment has all the beneficial effects of the pixel circuit provided by any one of the above embodiments, which will not be described in detail here.

An embodiment of the present disclosure also provides a display device which includes a display panel provided by the above embodiment, that is, includes the pixel circuit provided by any one of the above embodiments, and thus, the display device provided by the present embodiment has all the beneficial effects of the pixel circuit provided by any one of the above embodiments, which will not be described in detail here.

What described above is only specific embodiments of the disclosure which do not limit the protection scope of this disclosure. Any change or substitution within the technical scope disclosed herein that can be thought of by anyone skilled in the technical field should be within the protection scope of this disclosure. Therefore, the protection scope of this disclosure is determined by the protection scope of the claims.

What we claim is:

1. A pixel circuit, comprising a reset subcircuit, a data refreshing subcircuit, a driving subcircuit, a light emission control subcircuit and a potential compensation subcircuit, wherein the reset subcircuit is connected with a driving node, and is configured to reset the driving node;

the data refreshing subcircuit is connected with the driving node, and is configured to store a data voltage and control a voltage of the driving node to be a first voltage;

the driving subcircuit is connected with the driving node and the light emission control subcircuit, respectively, and is configured to be turned on or off according to the voltage of the driving node;

the light emission control subcircuit is connected with a light emitting element, and is configured to control a light emission driving voltage to be written in an anode node of the light emitting element via the driving subcircuit and the light emission control subcircuit;

the potential compensation subcircuit is connected with the light emitting element, and is used for controlling a junction voltage of the light emitting element to be within a preset voltage range according to an initial voltage input by an initialization reset voltage terminal and a reset sequence input by a reset sequence signal terminal, wherein the preset voltage range is higher than zero and lower than an emission threshold voltage of the light emitting element;

wherein the potential compensation subcircuit is further electrically connected to a preset sequence signal terminal, wherein the preset sequence signal terminal is used for inputting a preset sequence, and the potential compensation subcircuit is used for controlling the junction voltage of the light emitting element to be within the preset voltage range according to the preset sequence, the initial voltage and the reset sequence;

wherein the preset sequence signal terminal is a compensation and refreshing sequence signal terminal, and the preset sequence is a compensation and refreshing sequence;

the potential compensation subcircuit comprises a reset transistor, a compensation transistor, and a compensation capacitor, wherein a gate of the reset transistor is electrically connected to the reset sequence signal terminal, a first electrode of the reset transistor is electrically connected to the initialization reset voltage terminal, and a second electrode of the reset transistor is electrically connected to a first electrode of the compensation transistor and a first electrode plate of the compensation capacitor;

a gate of the compensation transistor is electrically connected to the compensation and refreshing sequence signal terminal, and a second electrode of the compensation transistor is electrically connected to the anode node;

a second electrode plate of the compensation capacitor is electrically connected to the initialization reset voltage terminal.

2. The pixel circuit according to claim 1, wherein the potential compensation subcircuit is at least connected to the initialization reset voltage terminal and the reset sequence signal terminal, and is used for, in a reset phase and/or a compensation and data refreshing phase, controlling the junction voltage of the light emitting element to be within the preset voltage range according to the initial voltage input by the initialization reset voltage terminal and the reset sequence input by the reset sequence signal terminal.

3. The pixel circuit according to claim 1, wherein the potential compensation subcircuit comprises a reset transistor and a compensation capacitor, wherein a gate of the reset transistor is electrically connected to the reset sequence signal terminal, a first electrode of the reset transistor is electrically connected to the initialization reset voltage terminal, and a second electrode of the reset transistor is electrically connected to the anode node;

a first electrode plate of the compensation capacitor is electrically connected to the reset sequence signal terminal, and a second electrode plate of the compensation capacitor is electrically connected to the anode node.

4. The pixel circuit according to claim 1, wherein the preset sequence signal terminal is a light emission driving sequence signal terminal, and the preset sequence is a light emission driving sequence;

the potential compensation subcircuit comprises a reset transistor, a compensation transistor and a compensation capacitor, wherein a gate of the reset transistor is electrically connected to the reset sequence signal terminal, a first electrode of the reset transistor is electrically connected to the initialization reset voltage terminal, and a second electrode of the reset transistor is electrically connected to a first electrode of the compensation transistor and a first electrode plate of the compensation capacitor;

a gate of the compensation transistor is electrically connected to the light emission driving sequence signal terminal, and a second electrode of the compensation transistor is electrically connected to the anode node;

a second electrode plate of the compensation capacitor is electrically connected to the anode node.

5. The pixel circuit according to claim 1, wherein, the reset subcircuit is connected to the driving node, the initialization reset voltage terminal and the reset sequence signal terminal, and is used for, in a reset phase in response to the reset sequence input by the reset sequence signal terminal, connecting the initialization reset voltage terminal to the driving node, and reset the driving node;

the data refreshing subcircuit is connected to the driving node, a compensation and refreshing sequence signal terminal, a light emission driving sequence signal terminal, a reference voltage input terminal and a data voltage input terminal, and is used for, in a compensation and data refreshing phase in response to a compensation and refreshing sequence input by the compensation and refreshing sequence signal terminal, writing a data voltage input by the data voltage input terminal in and store the data voltage; and in a light emission driving phase, in response to a light emission driving sequence input by the light emission driving sequence signal terminal, controlling the voltage of the driving node to decrease to the first voltage according to the data voltage and a reference voltage input by the reference voltage input terminal;

the driving subcircuit is connected to the driving node, a light emission driving voltage input terminal, and the data refreshing subcircuit, and is used for, in the reset phase in response to a reset voltage of the driving node, being turned on; in the compensation and data refreshing phase, maintaining a turned-on state to allow the light emission driving voltage input terminal to charge the driving node via the driving subcircuit and the data refreshing subcircuit till the voltage of the driving node increases to a second voltage to turn off the driving subcircuit; and in the light emission driving phase in response to the first voltage, being turned on;

the light emission control subcircuit is connected to the driving subcircuit, the anode node of the light emitting element, and the light emission driving sequence signal terminal, and is used for, in the light emission driving phase in response to the light emission driving sequence input by the light emission driving sequence signal terminal, being turned on to write the light emission driving voltage input by the light emission driving voltage input terminal in the anode node via the driving subcircuit and the light emission control subcircuit to control the light emitting element to emit light.

6. The pixel circuit according to claim 5, wherein, the driving subcircuit comprises a third transistor, and the light emission control subcircuit comprises an eighth transistor, wherein a gate of the third transistor is electrically connected to the driving node, a first electrode of the third transistor is electrically connected to the light emission driving voltage input terminal, and a second electrode of the third transistor is electrically connected to a first electrode of the eighth transistor;

a gate of the eighth transistor is electrically connected to the light emission driving sequence signal terminal, and a second electrode of the eighth transistor is electrically connected to the anode node.

7. The pixel circuit according to claim 6, wherein the data refreshing subcircuit comprises:

a power storage element, a second electrode plate of which is electrically connected to the driving node;

a first transistor, a gate of which is electrically connected to the compensation and refreshing sequence signal terminal, a first electrode of which is electrically connected to the data voltage input terminal, and a second electrode of which is electrically connected to a first electrode plate of the power storage element;

a second transistor, a gate of which is electrically connected to the compensation and refreshing sequence signal terminal, a first electrode of which is electrically connected to a second electrode of the third transistor, and a second electrode of which is electrically connected to the driving node, and a sixth transistor, a gate of which is electrically connected to the light emission driving sequence signal terminal, a first electrode of which is electrically connected to the reference voltage input terminal, and a second electrode of which is electrically connected to the first electrode plate of the power storage element.

8. The pixel circuit according to claim 7, wherein the reset subcircuit comprises:

a fifth transistor, a gate of which is electrically connected to the reset sequence signal terminal, a first electrode of which is electrically connected to the reference voltage input terminal, and a second electrode of which is electrically connected to the first electrode plate of the power storage element; and a fourth transistor, a gate of which is electrically connected to the reset sequence signal terminal, a first electrode of which is electrically connected to the initialization reset voltage terminal, and a second electrode of which is electrically connected to the driving node.

9. The pixel circuit according to claim 5, wherein the reset subcircuit comprises a fifth transistor and a fourth transistor, the data refreshing subcircuit comprises a power storage element, a first transistor, a second transistor and a sixth transistor, the driving subcircuit comprises a third transistor, the light emission control subcircuit comprises an eighth transistor, and the potential compensation subcircuit comprises a reset transistor and a compensation capacitor, wherein a gate of the first transistor is electrically connected to the compensation and refreshing sequence signal terminal, a first electrode of the first transistor is electrically connected to the data voltage input terminal, and a second electrode of the first transistor is electrically connected to a first electrode plate of the power storage element;

a second electrode plate of the power storage element is electrically connected to the driving node;

a gate of the second transistor is electrically connected to the compensation and refreshing sequence signal terminal, a first electrode of the second transistor is electrically connected to a second electrode of the third transistor, and a second electrode of the second transistor is electrically connected to the driving node, and a gate of the third transistor is electrically connected to the driving node, a first electrode of the third transistor is electrically connected to the light emission driving voltage input terminal, and a second electrode of the third transistor is electrically connected to a first electrode of the eighth transistor;

a gate of the fourth transistor is electrically connected to the reset sequence signal terminal, a first electrode of the fourth transistor is electrically connected to the initialization reset voltage terminal, and a second electrode of the fourth transistor is electrically connected to the driving node;

a gate of the fifth transistor is electrically connected to the reset sequence signal terminal, a first electrode of the fifth transistor is electrically connected to the reference voltage input terminal, and a second electrode of the fifth transistor is electrically connected to the first electrode plate of the power storage element;

a gate of the sixth transistor is electrically connected to the light emission driving sequence signal terminal, a first electrode of the sixth transistor is electrically connected to the reference voltage input terminal, and a second electrode of the sixth transistor is electrically connected to the first electrode plate of the power storage element;

a gate of the reset transistor is electrically connected to the reset sequence signal terminal, a first electrode of the reset transistor is electrically connected to the initialization reset voltage terminal, and a second electrode of the reset transistor is electrically connected to the anode node;

a first electrode plate of the compensation capacitor is electrically connected to the reset sequence signal terminal, and a second electrode plate of the compensation capacitor is electrically connected to the anode node; and a gate of the eighth transistor is electrically connected to the light emission driving sequence signal terminal, and a second electrode of the eighth transistor is electrically connected to the anode node.

10. The pixel circuit according to claim 5, wherein the potential compensation subcircuit is further electrically connected to the compensation and refreshing sequence signal terminal; the reset subcircuit comprises a fifth transistor and a fourth transistor, the data refreshing subcircuit comprises a power storage element, a first transistor, a second transistor, and a sixth transistor, the driving subcircuit comprises a third transistor, the light emission control subcircuit comprises an eighth transistor, and the potential compensation subcircuit comprises a reset transistor, a compensation transistor, and a compensation capacitor, wherein a gate of the first transistor is electrically connected to the compensation and refreshing sequence signal terminal, a first electrode of the first transistor is electrically connected to the data voltage input terminal, and a second electrode of the first transistor is electrically connected to a first electrode plate of the power storage element;

a second electrode plate of the power storage element is electrically connected to the driving node;

a gate of the second transistor is electrically connected to the compensation and refreshing sequence signal terminal, a first electrode of the second transistor is electrically connected to a second electrode of the third transistor, and a second electrode of the second transistor is electrically connected to the driving node, a gate of the third transistor is electrically connected to the driving node, a first electrode of the third transistor is electrically connected to the light emission driving voltage input terminal, and the second electrode of the third transistor is electrically connected to a first electrode of the eighth transistor;

a gate of the fourth transistor is electrically connected to the reset sequence signal terminal, a first electrode of the fourth transistor is electrically connected to the initialization reset voltage terminal, and a second electrode of the fourth transistor is electrically connected to the driving node;

a gate of the fifth transistor is electrically connected to the reset sequence signal terminal, a first electrode of the fifth transistor is electrically connected to the reference voltage input terminal, and a second electrode of the fifth transistor is electrically connected to the first electrode plate of the power storage element;

a gate of the sixth transistor is electrically connected to the light emission driving sequence signal terminal, a first electrode of the sixth transistor is electrically connected to the reference voltage input terminal, and a second electrode of the sixth transistor is electrically connected to the first electrode plate of the power storage element;

a gate of the reset transistor is electrically connected to the reset sequence signal terminal, a first electrode of the reset transistor is electrically connected to the initialization reset voltage terminal, and a second electrode of the reset transistor is electrically connected to a first electrode of the compensation transistor and a first electrode plate of the compensation capacitor;

a gate of the compensation transistor is electrically connected to the compensation and refreshing sequence signal terminal, and a second electrode of the compensation transistor is electrically connected to the anode node;

a second electrode plate of the compensation capacitor is electrically connected to the initialization reset voltage terminal; and a gate of the eighth transistor is electrically connected to the light emission driving sequence signal terminal, and a second electrode of the eighth transistor is electrically connected to the anode node.

11. The pixel circuit according to claim 5, wherein the potential compensation subcircuit is further electrically connected to the light emission driving sequence signal terminal; the reset subcircuit comprises a fifth transistor and a fourth transistor, the data refreshing subcircuit comprises a power storage element, a first transistor, a second transistor, and a sixth transistor, the driving sub circuit comprises a third transistor, the light emission control subcircuit comprises an eighth transistor, and the potential compensation subcircuit comprises a reset transistor, a compensation transistor, and a compensation capacitor, wherein a gate of the first transistor is electrically connected to the compensation and refreshing sequence signal terminal, a first electrode of the first transistor is electrically connected to the data voltage input terminal, and a second electrode of the first transistor is electrically connected to a first electrode plate of the power storage element;

a second electrode plate of the power storage element is electrically connected to the driving node;

a gate of the second transistor is electrically connected to the compensation and refreshing sequence signal terminal, a first electrode of the second transistor is electrically connected to a second electrode of the third transistor, and a second electrode of the second transistor is electrically connected to the driving node, a gate of the third transistor is electrically connected to the driving node, a first electrode of the third transistor is electrically connected to the light emission driving voltage input terminal, and a second electrode of the third transistor is electrically connected to a first electrode of the eighth transistor;

a gate of the fourth transistor is electrically connected to the reset sequence signal terminal, a first electrode of the fourth transistor is electrically connected to the initialization reset voltage terminal, and a second electrode of the fourth transistor is electrically connected to the driving node;

a gate of the fifth transistor is electrically connected to the reset sequence signal terminal, a first electrode of the fifth transistor is electrically connected to the reference voltage input terminal, and a second electrode of the fifth transistor is electrically connected to a first electrode plate of the power storage element;

a gate of the sixth transistor is electrically connected to the light emission driving sequence signal terminal, a first electrode of the sixth transistor is electrically connected to the reference voltage input terminal, and a second electrode of the sixth transistor is electrically connected to the first electrode plate of the power storage element;

a gate of the reset transistor is electrically connected to the reset sequence signal terminal, a first electrode of the reset transistor is electrically connected to the initialization reset voltage terminal, and a second electrode of the reset transistor is electrically connected to a first electrode of the compensation transistor and a first electrode plate of the compensation capacitor;

a gate of the compensation transistor is electrically connected to the light emission driving sequence signal terminal, and a second electrode of the compensation transistor is electrically connected to the anode node;

a second electrode plate of the compensation capacitor is electrically connected to the anode node; and a gate of the eighth transistor is electrically connected to the light emission driving sequence signal terminal, and a second electrode of the eighth transistor is electrically connected to the anode node.

12. The pixel circuit according to claim 1, wherein the reset subcircuit is connected to the driving node, the initialization reset voltage terminal, and the reset sequence signal terminal, and is used for, in a reset phase in response to the reset sequence input by the reset sequence signal terminal, connecting the initialization reset voltage terminal to the driving node, and reset the driving node;

the data refreshing subcircuit is connected to the driving node, a compensation and refreshing sequence signal terminal, a light emission driving voltage input terminal and a data voltage input terminal, and is used for, in a compensation and data refreshing phase in response to a compensation and refreshing sequence input by the compensation and refreshing sequence signal terminal, writing a data voltage input by the data voltage input terminal and storing the data voltage till the voltage of the driving node is the first voltage;

the driving subcircuit is connected to the driving node, the light emission control subcircuit and the data refreshing subcircuit, and is used for, in the reset phase in response to a reset voltage of the driving node, being turned on; in the compensation and data refreshing phase, maintain a turned-on state till the voltage of the driving node is the first voltage to turn off the driving subcircuit; and in a light emission driving phase in response to the first voltage, be turned on;

the light emission control subcircuit is connected to the driving subcircuit, the anode node of the light emitting element, the light emission driving voltage input terminal, and a light emission driving sequence signal terminal, and is used for, in the light emission driving phase in response to a light emission driving sequence input by the light emission driving sequence signal terminal, being turned on to write the light emission driving voltage input by the light emission driving voltage input terminal in the anode node via the driving subcircuit and the light emission control subcircuit to control the light emitting element to emit light.

13. The pixel circuit according to claim 12, wherein the reset subcircuit comprises a fifteenth transistor, the data refreshing subcircuit comprises a power storage element, a twelfth transistor, and a thirteenth transistor; the driving subcircuit comprises an eleventh transistor, the light emission control subcircuit comprises a fourteenth transistor and a seventeenth transistor, and the potential compensation subcircuit comprises a reset transistor, and a compensation capacitor, wherein a gate of the eleventh transistor is electrically connected to the driving node, a first electrode of the eleventh transistor is electrically connected to a second electrode of the twelfth transistor and a second electrode of the seventeenth transistor, and a second electrode of the eleventh transistor is electrically connected to a second electrode of the thirteenth transistor and a second electrode of the fourteenth transistor;

a first electrode plate of the power storage element is electrically connected to the light emission driving voltage input terminal, and a second electrode plate of the power storage element is electrically connected to the driving node;

a gate of the twelfth transistor is electrically connected to a compensation and refreshing sequence signal terminal, a first electrode of the twelfth transistor is electrically connected to the data voltage input terminal;

a gate of the thirteenth transistor is electrically connected to the compensation and refreshing sequence signal terminal, a first electrode of the thirteenth transistor is electrically connected to the driving node;

a gate of the fourteenth transistor is electrically connected to the light emission driving sequence signal terminal, and a first electrode of the fourteenth transistor is electrically connected to the anode node;

a gate of the fifteenth transistor is electrically connected to the reset sequence signal terminal, a first electrode of the fifteenth transistor is electrically connected to the initialization reset voltage terminal, and a second electrode of the fifteenth transistor is electrically connected to the driving node;

a gate of the seventeenth transistor is electrically connected to the light emission driving sequence signal terminal, and a first electrode of the seventeenth transistor is electrically connected to the light emission driving voltage input terminal;

a gate of the reset transistor is electrically connected to the reset sequence signal terminal, a first electrode of the reset transistor is electrically connected to the initialization reset voltage terminal, and a second electrode of the reset transistor is electrically connected to the anode node; and a first electrode plate of the compensation capacitor is electrically connected to the reset sequence signal terminal, and a second electrode plate of the compensation capacitor is electrically connected to the anode node.

14. The pixel circuit according to claim 12, wherein the potential compensation subcircuit is further electrically connected to the compensation and refreshing sequence signal terminal; the reset subcircuit comprises a fifteenth transistor, the data refreshing subcircuit comprises a power storage element, a twelfth transistor and a thirteenth transistor, the driving subcircuit comprises an eleventh transistor, the light emission control subcircuit comprises a fourteenth transistor and a seventeenth transistor, and the potential compensation subcircuit comprises a reset transistor, a compensation transistor and a compensation capacitor, wherein a gate of the eleventh transistor is electrically connected to the driving node, a first electrode of the eleventh transistor is electrically connected to a second electrode of the twelfth transistor and a second electrode of the seventeenth transistor, and a second electrode of the eleventh transistor is electrically connected to a second electrode of the thirteenth transistor and a second electrode of the fourteenth transistor;

a first electrode plate of the power storage element is electrically connected to the light emission driving voltage input terminal, and a second electrode plate of the power storage element is electrically connected to the driving node;

a gate of the twelfth transistor is electrically connected to the compensation and refreshing sequence signal terminal, a first electrode of the twelfth transistor is electrically connected to the data voltage input terminal;

a gate of the thirteenth transistor is electrically connected to the compensation and refreshing sequence signal terminal, a first electrode of the thirteenth transistor is electrically connected to the driving node;

a gate of the fourteenth transistor is electrically connected to the light emission driving sequence signal terminal, and a first electrode of the fourteenth transistor is electrically connected to the anode node;

a gate of the fifteenth transistor is electrically connected to the reset sequence signal terminal, a first electrode of the fifteenth transistor is electrically connected to the initialization reset voltage terminal, and a second electrode of the fifteenth transistor is electrically connected to the driving node;

a gate of the seventeenth transistor is electrically connected to the light emission driving sequence signal terminal, and a first electrode of the seventeenth transistor is electrically connected to the light emission driving voltage input terminal;

a gate of the reset transistor is electrically connected to the reset sequence signal terminal, a first electrode of the reset transistor is electrically connected to the initialization reset voltage terminal, and a second electrode of the reset transistor is electrically connected to a first electrode of the compensation transistor and a first electrode plate of the compensation capacitor;

a gate of the compensation transistor is electrically connected to the compensation and refreshing sequence signal terminal, and a second electrode of the compensation transistor is electrically connected to the anode node; and a second electrode plate of the compensation capacitor is electrically connected to the initialization reset voltage terminal.

15. The pixel circuit according to claim 12, wherein the potential compensation subcircuit is further electrically connected to the light emission driving sequence signal terminal; the reset subcircuit comprises a fifteenth transistor, the data refreshing subcircuit comprises a power storage element, a twelfth transistor and a thirteenth transistor, the driving subcircuit comprises an eleventh transistor, the light emission control subcircuit comprises a fourteenth transistor and a seventeenth transistor, and the potential compensation subcircuit comprises a reset transistor, a compensation transistor, and a compensation capacitor, wherein a gate of the eleventh transistor is electrically connected to the driving node, a first electrode of the eleventh transistor is electrically connected to a second electrode of the twelfth transistor and a second electrode of the seventeenth transistor, and a second electrode of the eleventh transistor is electrically connected to a second electrode of the thirteenth transistor and a second electrode of the fourteenth transistor;

a first electrode plate of the power storage element is electrically connected to the light emission driving voltage input terminal, and a second electrode plate of the power storage element is electrically connected to the driving node;

a gate of the twelfth transistor is electrically connected to the compensation and refreshing sequence signal terminal, and a first electrode of the twelfth transistor is electrically connected to the data voltage input terminal;

a gate of the thirteenth transistor is electrically connected to the compensation and refreshing sequence signal terminal, and a first electrode of the thirteenth transistor is electrically connected to the driving node;

a gate of the fourteenth transistor is electrically connected to the light emission driving sequence signal terminal, and a first electrode of the fourteenth transistor is electrically connected to the anode node;

a gate of the fifteenth transistor is electrically connected to the reset sequence signal terminal, a first electrode of the fifteenth transistor is electrically connected to the initialization reset voltage terminal, and a second electrode of the fifteenth transistor is electrically connected to the driving node;

a gate of the seventeenth transistor is electrically connected to the light emission driving sequence signal terminal, and a first electrode of the seventeenth transistor is electrically connected to the light emission driving voltage input terminal;

a gate of the reset transistor is electrically connected to the reset sequence signal terminal, a first electrode of the reset transistor is electrically connected to the initialization reset voltage terminal, and a second electrode of the reset transistor is electrically connected to a first electrode of the compensation transistor and a first electrode plate of the compensation capacitor;

a gate of the compensation transistor is electrically connected to the light emission driving sequence signal terminal, and a second electrode of the compensation transistor is electrically connected to the anode node; and a second electrode plate of the compensation capacitor is electrically connected to the anode node.

16. The pixel circuit according to claim 1, wherein a plurality of pixel circuits are electrically connected in cascade, a reset sequence signal terminal of the pixel circuit at a present stage is a compensation and refreshing sequence signal terminal of the pixel circuit at a previous stage.

17. A display panel, comprising the pixel circuit according to claim 1.

18. A display device, comprising the display panel according to claim 17.

* * * * *